US011342709B2

(12) United States Patent
Brennauer

(10) Patent No.: US 11,342,709 B2
(45) Date of Patent: May 24, 2022

(54) CABLE CONNECTOR HAVING A LATCHING LEVER

(71) Applicant: ept Holding GmbH & Co. KG, Peiting (DE)

(72) Inventor: Georg Brennauer, Wildsteig (DE)

(73) Assignee: EPT HOLDING GMBH & CO. KG, Peiting (DE)

( * ) Notice: Subject to any disclaimer, the term of this patent is extended or adjusted under 35 U.S.C. 154(b) by 0 days.

(21) Appl. No.: 16/899,807

(22) Filed: Jun. 12, 2020

(65) Prior Publication Data

US 2020/0395712 A1 Dec. 17, 2020

(30) Foreign Application Priority Data

Jun. 13, 2019 (DE) ..... 10 2019 116 140.1

(51) Int. Cl.
*H01R 13/627* (2006.01)
*H01R 24/60* (2011.01)

(52) U.S. Cl.
CPC ..... *H01R 13/6273* (2013.01); *H01R 24/60* (2013.01)

(58) Field of Classification Search
CPC ..... H01R 13/6272; H01R 13/6273; H01R 13/6271–6275; H01R 24/60
USPC ..... 439/358, 357
See application file for complete search history.

(56) References Cited

U.S. PATENT DOCUMENTS 5,154,629 A * 10/1992 Carver ..... G02B 6/3817 439/352
5,340,329 A * 8/1994 Hirai ..... H01R 13/6275 439/357
6,074,237 A * 6/2000 Lee ..... H01R 4/2433 439/358
7,201,601 B2 4/2007 Lappoehn
7,874,846 B2 * 1/2011 Gunderson ..... G11B 33/122 439/66
9,640,910 B1 * 5/2017 Chien ..... G06F 13/409
2003/0143886 A1 * 7/2003 Nemoto ..... H01R 13/62977 439/352
2008/0076282 A1 * 3/2008 Yamaji ..... H01R 13/6275 439/153
2009/0035982 A1 * 2/2009 Chen ..... H01R 13/6275 439/358
2010/0041267 A1 * 2/2010 Chiang ..... H01R 13/506 439/367

(Continued)

FOREIGN PATENT DOCUMENTS

DE 10 2004 054 203 A1 5/2006
WO 99/66598 A1 12/1999

OTHER PUBLICATIONS

Examination Report issued in German Patent Application No. 10 2019 116 140.1 dated Feb. 14, 2020 with English translation provided.

*Primary Examiner* — Gary F Paumen
(74) *Attorney, Agent, or Firm* — Nixon & Vanderhye

(57) ABSTRACT

A cable connector, especially an IDC (Insulation Displacement Connector) connector, has an insulating body and an abutment bridge. The insulating body includes a housing and locking elements integrally manufactured with the housing. The locking elements include a lever and a bearing axle. The lever is doubly connected to the housing. A bearing axle of the locking element is designed to be inserted into a bearing recess of the abutment bridge.

12 Claims, 4 Drawing Sheets

(56) References Cited

U.S. PATENT DOCUMENTS

2014/0273585 A1* 9/2014 Dang ..... H01R 13/58
439/345
2016/0359272 A1* 12/2016 Houry ..... H01R 13/639

* cited by examiner

CABLE CONNECTOR HAVING A LATCHING LEVER

TECHNICAL FIELD

The invention relates to a cable connector, in particular an IDC (Insulation Displacement Connector) connector, comprising an insulating body and an abutment bridge, the insulating body having at least one locking element for mutually locking with a plug connector.

STATE OF THE ART

Cable connectors are known in different embodiments. They usually have an insulating body which carries contacts for connection with a plug connector (e.g. a PCB socket). On the cable side, the connecting contacts are designed as insulation displacement contacts which are connected to cable ends, for example using LSA technology, via a crimp connection, an IDC connection, etc. The connection is made, for example, by inserting the cable ends into an abutment bridge and then, when the abutment bridge is moved relative to the insulating body, making an electrical connection with the terminal contacts.

In order to connect the cable connector permanently and securely to the mating plug connector, in particular to prevent the cable connector from being pulled out when the cables are subjected to tensile stress, the cable connector usually has a locking mechanism that establishes a lock between the mating connector and the cable connector connected to it. The locking mechanism may have locking/latching levers which are part of the insulation body.

The locking levers can be made in one piece (formed integrally) with the insulation body. However, this causes several problems. First, the locking levers are thin and soft when the connectors have small dimensions. As a result, the locking lever offers little back pressure during actuation and thus little feedback for the user as to whether actuation has actually taken place. The user therefore tends to apply too much force and to break or destroy the lever. When removing the plug connector from the cable connector, the lack of feedback can cause the user to want to disconnect the plug without actuation, with the result that the locking lever breaks off near a locking lug.

Furthermore, in this variant the connection of the locking lever to the base body of the insulating body is designed as a swivel/hinge and therefore designed to be very thin. This means a high risk of the lever tearing off at the hinge, especially under high load or if the connector is repeatedly attached to or detached from the mating connector. In addition, both the spring travel and the spring force are low with a thin connection between the locking lever and the base body of the insulating body.

For these reasons, solutions have been developed in which the locking lever and the base body of the insulating body are designed in two parts. The parts are connected via a bearing which allows a rotational movement of the locking lever (rocker). Although the axle bearing is relatively secure against damage and robust, the moulding process as a whole is complex. Furthermore, during assembly an additional step is required, namely, attaching and mounting the locking lever to the base body of the insulating body.

OBJECT OF THE INVENTION

Therefore, it is an object of the present invention to provide a cable connector having a latching lever which is stable and easy to manufacture.

SUMMARY OF THE INVENTION

This object is solved by providing a cable connector according to claim 1. Features of preferred embodiments of the invention are subject of the dependent claims.

The cable connector according to the invention comprises an insulating body and an abutment bridge, the insulating body having at least one locking element for mutually locking with a mating connector. The abutment bridge has at least one bearing for supporting a bearing axle (bearing shaft) of a locking lever of the insulating body.

The bearing of the bearing axle of the insulating body or the locking element in the abutment bridge prevents the danger of a break in the hinge or a break of a connection between the locking lever and a base body of the insulating body. With this design, during mounting the abutment bridge and the insulating body, bearing the insulating body and the abutment bridge and providing electric contacting between cables and the contact terminals of the cable connector can be carried out in one step.

The invention is particularly relevant for cable connections, since tensile forces can be exerted on the connector via cables, which can result in unintentional withdrawal of the cable connector from the mating plug connector. For this reason, a safety device, usually in the form of a locking mechanism, is required.

IDC (Insulation Displacement Connector) plugs are an example of an application of the cable connector according to the invention. In this technique, wires of a cable, e.g. a ribbon cable, are inserted into respective receiving slots provided in the abutment bridge and then pressed together with the insulation displacement contacts located in the insulating body, whereby the wires are contacted by the insulation displacement connectors.

In particular, the insulating body has a housing, the housing and the at least one locking element being formed in one piece, i.e. integrally. The construction of the insulating body can be in one piece, i.e. the housing (hereinafter also referred to as the base body) and the locking elements can be designed in one piece. This means that, compared to a two-piece design, additional components and an additional assembly step when attaching the additional component to the basic body can be avoided.

Preferably the at least one locking element is connected to the housing via at least two connecting elements. Due to the double connection of the locking elements, particularly of the levers of the locking elements, the insulating body as a single part is mechanically stable and robust against external influences. The spring elements are securely connected to the single-part insulating body.

Preferably, the locking element has a lever which comprises a rocker and a spring bar. The spring bar can be one of the above-mentioned connecting elements. It preferably extends from the area of a locking lug or detent hook located in the end area of the rocker to the base body/housing of the insulating body and thus forms the second connection. The danger of kinking in this area is reduced due to a strong, double connection between the housing and the rocker.

In the design in accordance with the invention, the locking lever can be deformed. However, instead of being deformed in the hinge, deformation can be facilitated by providing a long lever having a spring bar. In this way a thicker spring bar can be realized, which does not bend out easily and offers higher holding force. Since the material load during the deformation of the long spring bar is low, materials can be used for the production of the insulating body which would be unsuitable for other constructions or which would not fulfil some of the partly contrary requirements, such as liquid crystal polymer (LCP) materials.

The spring bar can be formed as a massive lever, the deformation of which can be adjusted in a way defined by the construction and the choice of material. The lead-in chamfer of the locking lugs can be made more or less flat or chamfered, allowing the locking lever to be designed with more pretension, for example.

In particular, the bearing of the abutment bridge can be designed as a recess in a base body of the abutment bridge, which is complementary to the bearing axis and bearing shaft, respectively, of the locking element. The recess can be designed e.g. semicircular.

In particular, the bearing axis of the locking element is out of engagement with the bearing recess of the abutment bridge in a first position of the insulating body relative to the abutment bridge, and in a second position of the insulating body relative to the abutment bridge the bearing axis is in engagement with the bearing recess of the abutment bridge. When the insulating body and the abutment bridge are brought together from the first relative position (separated position) to the second relative position (insertion position), the bearing axle is moved into the bearing recess of the abutment bridge in order to be securely supported therein.

The cable connector may have a locking device which locks the abutment bridge in the second state against separation of the abutment bridge from the insulating body. The locking device can be provided, for example, by a latch between the abutment bridge and the insulation body. Even in the first state, the abutment bridge can be secured against unintentional removal by means of a latch connection between the bridge and the insulating body.

The locking element, which can be, for example, a latching element for latching with a mating plug connector, may have a blocking element which, in the first state, abuts a first stop of the abutment bridge, and, in the second state, engages an undercut of the insulating body. In the first state, the rocker is locked in a T-shaped groove which forms a third fixing point.

The insulating body can be made in one piece of a liquid crystal polymer (LCP) material. Even if the materials used do not fulfil all the desired (sometimes contrary) properties, such as resistance to breakage, stiffness, elasticity, etc., the constructive measures proposed by this invention achieve that the disadvantages of the absence of individual material properties are reduced or eliminated.

BRIEF DESCRIPTION OF THE FIGURES

Further advantages, features and possible applications of the invention result from the following description of a preferred, but not restrictive, exemplary embodiment of the invention based on the drawings, with the drawings showing.

DETAILED DESCRIPTION OF A PREFERRED EMBODIMENT

Figure 1:
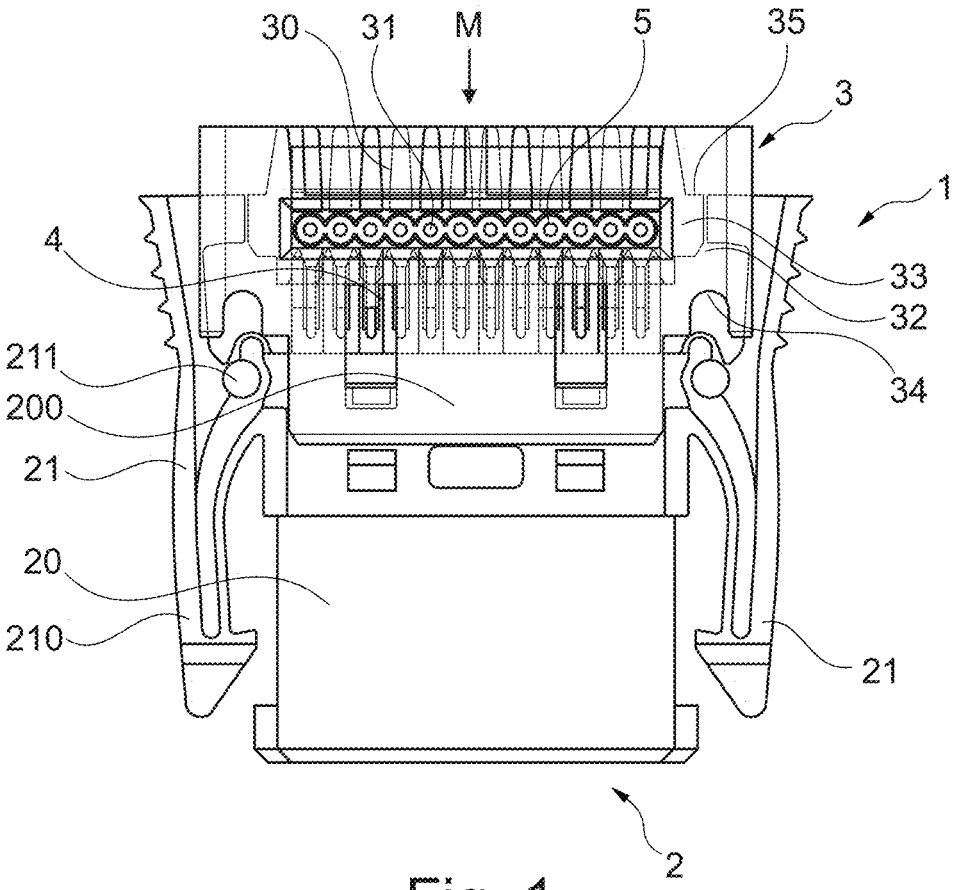
FIG. 1 a front view of a cable connector according to the invention, whereby some individual components are shown semi-transparently.

FIG. 1 shows a cable connector 1, especially an IDC (Insulation Displacement Connector) connector, which is in accordance with the invention. The cable connector 1 comprises an insulating body 2 and an abutment bridge 3.

The insulating body 2 comprises a housing 20 and locking elements 21, in this case latching elements 21, which are respectively arranged on the sides of the housing 20. The housing 20 has a receiving space 200 for receiving at least a portion of the abutment bridge 3. In addition, the housing 20 contains a plurality of contacts 4, which are especially designed as insulation displacement and/or clamping contacts arranged side by side.

Figure 2A:
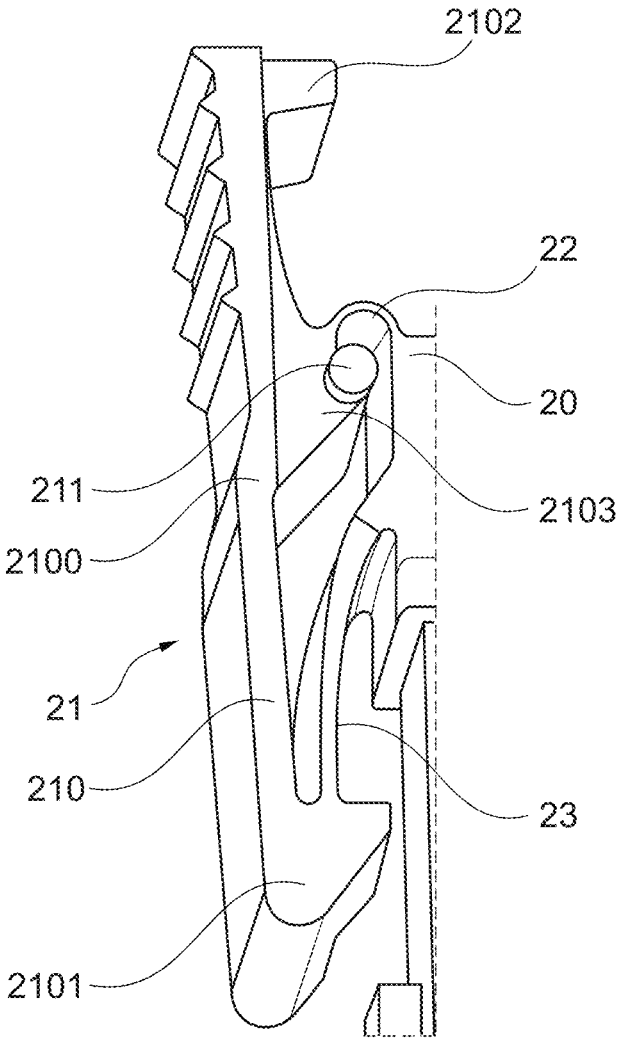
FIG. 2*a* a detail of the cable connector according to FIG. 1.

A locking element 21 shown in detail in FIG. 2*a* is designed as a detent element and comprises a lever 210 and a bearing axle 211. The lever 210 has a rocker 2100, a locking lug 2101 and an abutment element 2102, the locking lug 2101 being arranged at a first end of the rocker 2100, the first end facing away from the abutment bridge 3, and the abutment element 2102 being arranged at a second end of the rocker 2100, the second end facing towards the abutment bridge 3. The rocker 2100 is connected to the bearing axle 211 by a direct connection 2103 extending from a central region of the rocker 2100. The bearing axle 211 is connected to the housing 20 via a connection 22 in the form of a curved thin spring element. In addition, the rocker 2100 is connected to the housing 20 via a web or a spring bar 23 extending from the locking lug 2101 in the direction of bearing axis 211. The connection of the rocker 2100 to the housing 20 is therefore double. If the insulating body 2 is formed integrally, i.e. as a single-piece or one-piece component, the double connection ensures a secure, stable connection of the locking element 21 to the housing and prevents the locking element 21 from breaking off easily from the housing 20. The design measures make it possible to manufacture the entire insulating body 2 in one piece from liquid crystal polymer (LCP) material. The one-piece production of locking element 21 with the housing 20 eliminates the assembly step of joining the above-mentioned components.

Figure 2B:
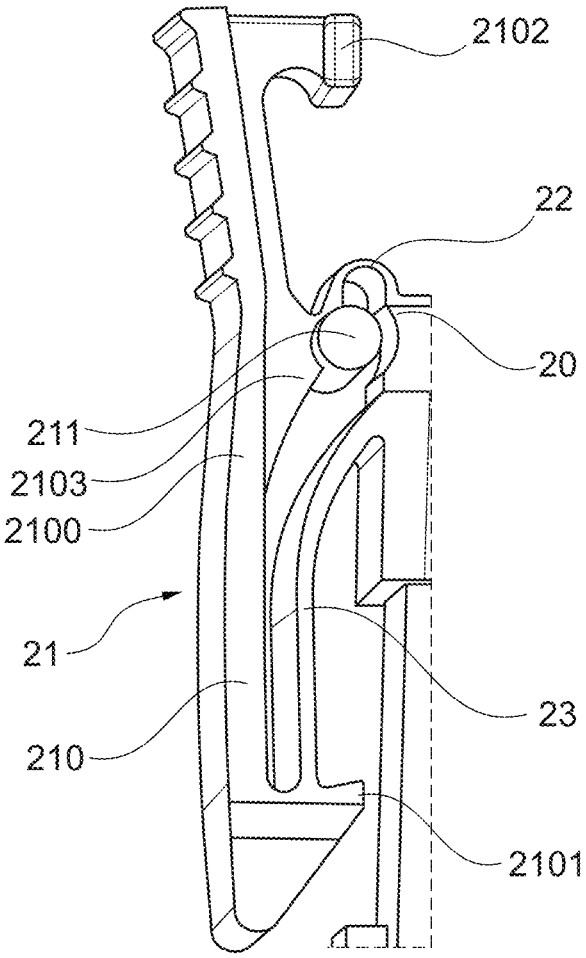
FIG. 2*b* a detail of a further version of a cable connector according to the invention.

FIG. 2*b* shows another version of the locking element 21, which substantially corresponds to that shown in FIG. 2*a*. The only difference is that the abutment element 2102 has a different design. The abutment element 2102 widens towards the free end and thus forms kind of hook.

The abutment bridge 3 has a base body 30. Inside the base body 30, receiving slots 31 are formed as receptacles in order to accommodate cables 5. In addition, the base body 30 has a stop 33 on each side for contacting the abutment elements 2102 in a first state before contacting (see FIG. 1), and T-shaped grooves 32 for receiving a respective abutment element 2102 of the locking element 21 in a second state after contacting (see FIG. 3). The stop 33 limits the mobility of the lever 210 in the first state as illustrated so that no damage can occur. In addition, the housing 30 has a bearing recess 34 on each side thereof to accommodate a respective bearing axle 211 of the locking element 21. The bearing recess 34 can, for example, have an inner contour of a sector of a circle, e.g. semi-circular inner contour.

In the first positioning shown in FIG. 1, the abutment element 2102 is supported between the insulating body 2 and the abutment bridge 3 in the T-shaped groove of the abutment bridge 3 and thus forms a third fixing point for the locking element 21. Therefore, the locking element 21 cannot be bent or worn out in this first positioning.

In the first positioning according to FIG. 1 the bearing axle 211 of the locking or detent element 21 is still positioned outside the bearing recess 34 of the abutment bridge 3.

Figure 3:
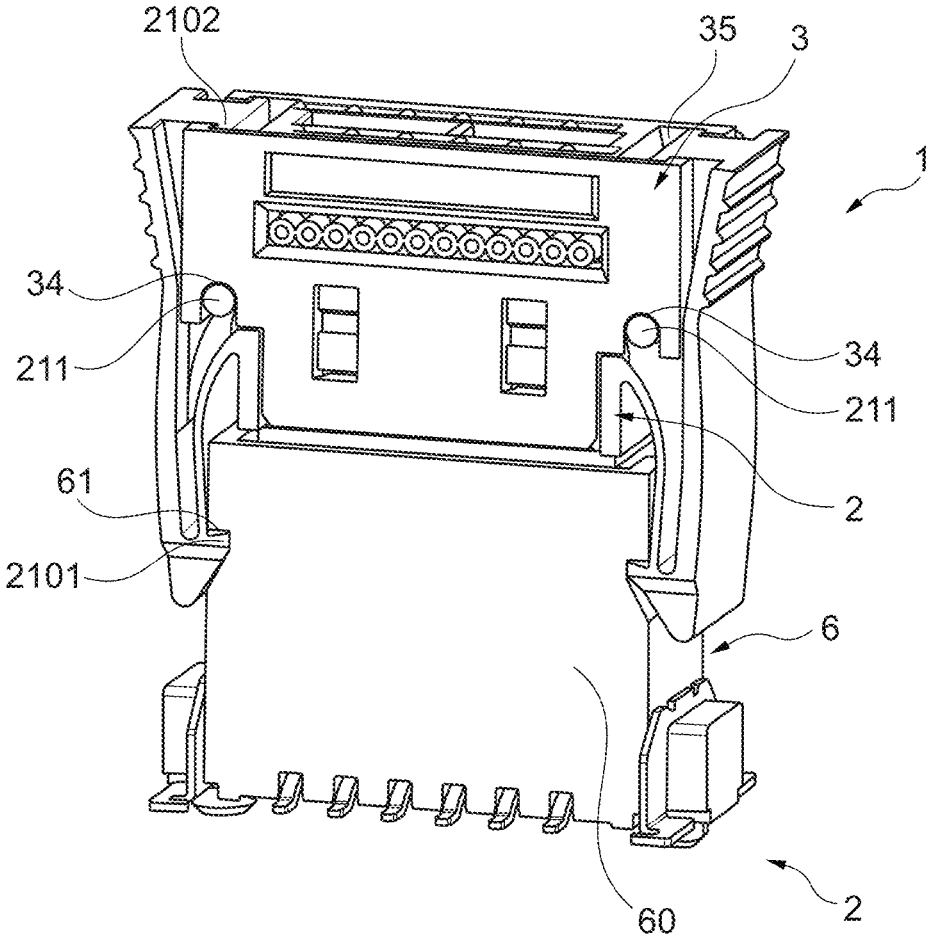
FIG. 3 a perspective view of the cable connector illustrated in FIG. 1, connected to a plug connector.

After the wires 5 of several cables or of a multi-section cable have been positioned in the corresponding cable receiving slots 31 of the abutment bridge 3, the abutment bridge 3 can be moved in the mounting direction (=direction of contact) M relative to the insulating body 2. The cable connector 1 changes to a second state (second positioning) as shown in FIG. 3. In FIG. 3 the insulating body 2 and the abutment bridge 3 are in complete mutual engagement. The abutment elements 2102 engage in a groove or undercut 35 formed behind the stops 33 (which are formed as projections; see FIG. 1). In addition, on both sides the bearing axles/bearing shafts 211 are moved into the respective bearing recess 34 and, as the bearing recesses 34 are designed to match the bearing shafts 211 (e.g. the bearing shafts 34 can have a circular cross section and the recesses 34 can have a semicircular inner contour), are safely supported therein. The stability of the bearing of the locking elements 21 would be guaranteed even if the connection 22 were to be torn off in this second position.

In the second position, the wires 5 positioned in the cable slots 31 of the abutment bridge 3 are pushed into the insulation displacement and/or clamping contacts 4 in order to establish an electrical connection with them, whether by cutting the insulation of the wire ends 5 through the insulation displacement contacts, forming an insulation displacement connection, by establishing a crimp connection, or similar.

In FIG. 3 the cable connector 1 is connected with a corresponding plug connector 6 matching the cable connector 1. The mating plug connector 6 is especially designed as a socket-like plug connector, e.g. as a printed circuit board socket. The mating connector 6 has a socket-like insulating body 60 with a receptacle for the cable connector 1, and undercuts 61 in which the locking lugs 2101 of the levers 210 engage in order to secure the cable connector 1 against loosening or uncoupling from the mating connector 6, especially against being pulled out of it.

The mounting direction for contacting is indicated by an arrow M. Contacting of electrical contacts and mounting the bearing shafts 211 in the bearing recesses 34 take place in one step, in which the abutment bridge 3 is moved relative to the insulating body 2 from the first state (FIG. 1) to the second state (FIG. 3).

LIST OF REFERENCE MARKS

1 cable connector
2 insulating body
20 housing
200 receiving space
21 locking element
210 lever
2100 rocker
2101 locking lug
2102 abutment element
2103 connection
211 bearing axle
22 connecting element: first connection
23 connecting element: spring bar
3 abutment bridge
30 base body
31 receiving slot
32 T-shaped groove
33 stop
34 bearing: recess
35 undercut
4 contacts
5 cable
6 plug connector
60 insulating body of the plug connector
61 undercut of the plug connector

The invention claimed is:

1. A cable connector (1), comprising:
an insulating body (2); and
an abutment bridge (3),
the insulating body (2) having at least one locking element (21) for mutual locking with a mating plug connector (6), the locking element (21) having a first free end, a second free end located opposite the first free end, and a mid-section in connection with the insulating body (2), the locking element (21) extending between the first free end and the second free end along a mounting direction (M), and having a bearing axle located between the first and second ends that extends in a direction perpendicular to the mounting direction,
wherein the abutment bridge (3) has at least one bearing recess (34) configured to receive the bearing axle (211) of the locking element (21) when the abutment bridge (3) engages with the insulating body (2) in the mounting direction (M).

2. The cable connector (1) according to claim 1, wherein the insulating body (2) has a housing (20), the housing (20) and the at least one locking element (21) being formed in one piece.

3. The cable connector (1) according to claim 2, wherein the at least one locking element (21) is connected to the housing (20) via at least two connecting elements (22, 23).

4. The cable connector (1) according to claim 1, wherein the locking element (21) has a lever (210) comprising a rocker (2100) and a spring bar (23).

5. The cable connector (1) according to claim 1, wherein the bearing recess (34) of the abutment bridge (3) is a recess formed in a base body (30) of the abutment bridge (3), said recess being formed to be complementary to the bearing axle (211) of the locking element (21).

6. The cable connector (1) according to claim 1, wherein the bearing axle (211) of the locking element (21) is out of engagement with the bearing recess (34) of the abutment bridge (3) in a first relative position of the insulating body (2) relative to the abutment bridge (3), and the bearing axle (211) of the locking element (21) is in engagement with the bearing recess (34) of the abutment bridge (3) in a second position of the insulating body (2) relative to the abutment bridge (3).

7. The cable connector (1) according to claim 6, further comprising:
a locking device which locks the abutment bridge (3) in the second position of the insulating body (2) relative to the abutment bridge (3) against separation of the abutment bridge (3) from the insulating body (2).

8. The cable connector (1) according to claim 6, wherein the locking element (21) has a locking lug (2101) which, in the first relative position of the insulating body (2) relative to the abutment bridge (3) bears against a first stop (33) of the abutment bridge (3), and, in the second relative position of the insulating body (2) relative to the abutment bridge (3), engages in an undercut (35) formed in the abutment bridge (3).

9. The cable connector (1) according to claim 1, wherein the insulating body (2) is made in one piece of a liquid crystal polymer (LCP) material.

10. The cable connector (1) according to claim 7, wherein the locking element (21) has a locking lug (2101) which, in the first relative position of the insulating body (2) relative to the abutment bridge (3) bears against a first stop (33) of the abutment bridge (3), and, in the second relative position of the insulating body (2) relative to the abutment bridge (3), engages in an undercut (35) formed in the abutment bridge (3).

11. The cable connector (1) according to claim 1, wherein the first end of the locking element (21) comprises a first projection, extending in a projecting direction perpendicular to both the mounting direction (M) and the direction of the bearing axle, that forms an abutment element (2102) for contacting the abutment bridge, and the second end of the locking element (21) comprises a second projection, extending in the projecting direction, that forms a locking lug (2101) for engagement with a mating plug connector.

12. The cable connector (1) according to claim 1, wherein the locking element (21), at one side of the bearing axle toward the first end, comprises a lever (210) that includes a rocker (2100) and a locking lug (2101), the locking element (21) being connected to the housing (20) via a spring element (22) located between the first and second free ends, and also connected to the housing (20) via a spring bar (23) separate from the lever (21) and extending from the locking lug (2101) toward the bearing axis (211).

* * * * *